US006210077B1

(12) United States Patent
Kondo

(10) Patent No.: US 6,210,077 B1
(45) Date of Patent: Apr. 3, 2001

(54) MECHANICAL GROUND ANCHOR

(75) Inventor: Shigeki Kondo, Chiba (JP)

(73) Assignee: Kabushikigaisha Jiban Shikenjo, Tokyo (JP)

( * ) Notice: Subject to any disclaimer, the term of this patent is extended or adjusted under 35 U.S.C. 154(b) by 0 days.

(21) Appl. No.: 09/271,453

(22) Filed: Mar. 18, 1999

(30) Foreign Application Priority Data

Mar. 19, 1998 (JP) ..... 10-090853

(51) Int. Cl.[7] ..... E02D 5/74
(52) U.S. Cl. ..... 405/244; 52/157; 175/98
(58) Field of Search ..... 405/244, 259.3, 405/259.4, 236, 237; 175/94, 98; 52/155–160

(56) References Cited

U.S. PATENT DOCUMENTS

| | | | | |
|---|---|---|---|---|
| 2,637,527 | * | 5/1953 | Andrews | 175/94 |
| 3,225,843 | * | 12/1965 | Ortloff et al. | 175/94 X |
| 3,962,837 | * | 6/1976 | Sero | 405/259.3 X |
| 4,160,613 | * | 7/1979 | Stanwick | 405/244 |
| 4,314,615 | * | 2/1982 | Sodder et al. | 175/94 |
| 4,342,527 | * | 8/1982 | White | 405/259.4 X |
| 4,547,106 | * | 10/1985 | Lipsker | 405/259.3 |
| 5,660,504 | * | 8/1997 | Reinert | 405/244 X |

FOREIGN PATENT DOCUMENTS

| | | |
|---|---|---|
| 51-103611 | 9/1976 | (JP) . |
| 52-46013 | 4/1977 | (JP) . |
| 63-194023 | 8/1988 | (JP) . |
| 4-13496 | 5/1989 | (JP) . |
| 3-32637 | 3/1991 | (JP) . |

* cited by examiner

*Primary Examiner*—David Bagnell
*Assistant Examiner*—Frederick L. Lagman
(74) *Attorney, Agent, or Firm*—Greenblum & Bernstein, P.L.C.

(57) ABSTRACT

A mechanical ground anchor is provided including an anchor body having a plurality of parts forming a cylindrical shape. The parts forming the cylindrical shape are mounted to be opened and closed in the horizontal direction by a slide mechanism and a drive mechanism for opening and/or closing the anchor body on a core material. Thus, it is possible to enlarge the section performance of the slide mechanism between the core material and anchor body, it thus is also possible to increase rotational torque and/or tensile strength, and in case of self-boring, hard soil foundation boring and extremely deep evacuation can be easily performed as a result.

16 Claims, 4 Drawing Sheets

MECHANICAL GROUND ANCHOR

BACKGROUND OF THE INVENTION

1. Field of the Invention

The present invention relates to a mechanical ground anchor, particularly to a ground anchor that is reusable and that provides a reactive force resistance body when subjected to loading.

2. Description of Background Information

Up to the present, a straddle type of the mechanical anchor is well known as a ground anchor available for such a loading. As one of the straddle type of mechanical anchors, a self-boring type is known as disclosed in Japanese Patent Application No. HEI 4-13496 of the same Applicant where a cylindrical shaped anchor body divided into two parts is connected to a head plate mounted at the bottom end of the drilling rod by using a joint pin. This mechanical anchor is designed so that the anchor body could be straddled taking the form of an inverted V-shape by means of a jack provided in the anchor body when it reaches a certain depth by self-boring. For reasons that such existing mechanical anchor is designed so as to join the anchor body to the head plate by using a pin joint, however, there were the following points at issue:

(1) In the case of such a pin-joint, its structural strength such as a magnitude of its rotational torque and/or tensile strength depends on its section performance such as the length and/or diameter of the pin, while, by reason of the limited structural space of the mechanical anchor, the available size of the pin is limited and its rotational torque and/or tensile strength are restricted as a result.

(2) The magnitude of its rotational torque while being bored remaining straddled depends on the soil foundation hardness and depth to be bored. For this reason, the existing mechanical anchor could not be applied to such hard soil foundation as pebbly stratum and/or extremely deep excavation in many cases of the self-boring.

(3) Tensile strength while the anchor body is applied remaining straddled also depends on section performance of the pin. For this reason, pulling resistance force depending on the soil foundation could not always be maximized.

(4) Because the straddled anchor body takes the form of cylinder divided into two parts that rotate during boring, and due to the condition that only its upper end is joined to the boring rod, the existing mechanical anchor has a weakness during rotary boring.

(5) In collapsible soil foundation, it is often effective to strengthen boring walls by means of injecting a soil stabilizer such as bentonite liquid into the boring wall and then straddle the anchor body. It is, however, impossible to inject such soil stabilizer with the existing mechanical anchor from a structural point of view.

SUMMARY OF THE INVENTION

It is a general object of this invention to provide an improved mechanical ground anchor enabling a considerable pulling resistance force by solving the problems of the prior art due to the pin joint, thus making it possible to excavate by generating a considerably higher torque even in the case of hard soil foundation and extremely deep excavation, and by making the anchor body fit to a considerable pulling resistance force required when using the anchor body remaining straddled.

In order to attain the foregoing object, the following are applied for the present invention:

The present invention relates to the mechanical ground anchor including an anchor body having a plurality of parts forming a cylindrical shape linked with the outer side of a core material. The parts are linked for opening and closing in the horizontal direction through a slide mechanism and a drive part, such as a jack, mounted on the core material for the purpose of opening and/or closing the anchor body.

The slide mechanism may include a slide piece receiving frame mounted inside the core material crosswise to its radial direction and a slide piece fastened on each part of the anchor body, with the slide piece being inserted into the slide piece receiving frame.

The slide mechanism of the present invention may alternatively include the slide piece formed so as to extend in the radial direction of the core material by fixing its inner end to the core material and by providing an equal number of slide piece receiving frames fastened to the anchor body at the opposite side of the core material, the slide piece receiving frame being inserted over the slide piece.

The slide mechanism of the present invention may further include a mechanism for mounting a boring bit on the tip of the core material and a screw on the outer circumferential edge of each anchor body.

DESCRIPTION OF THE INVENTION

The following description deals with the preferred embodiment.

Figure 1:
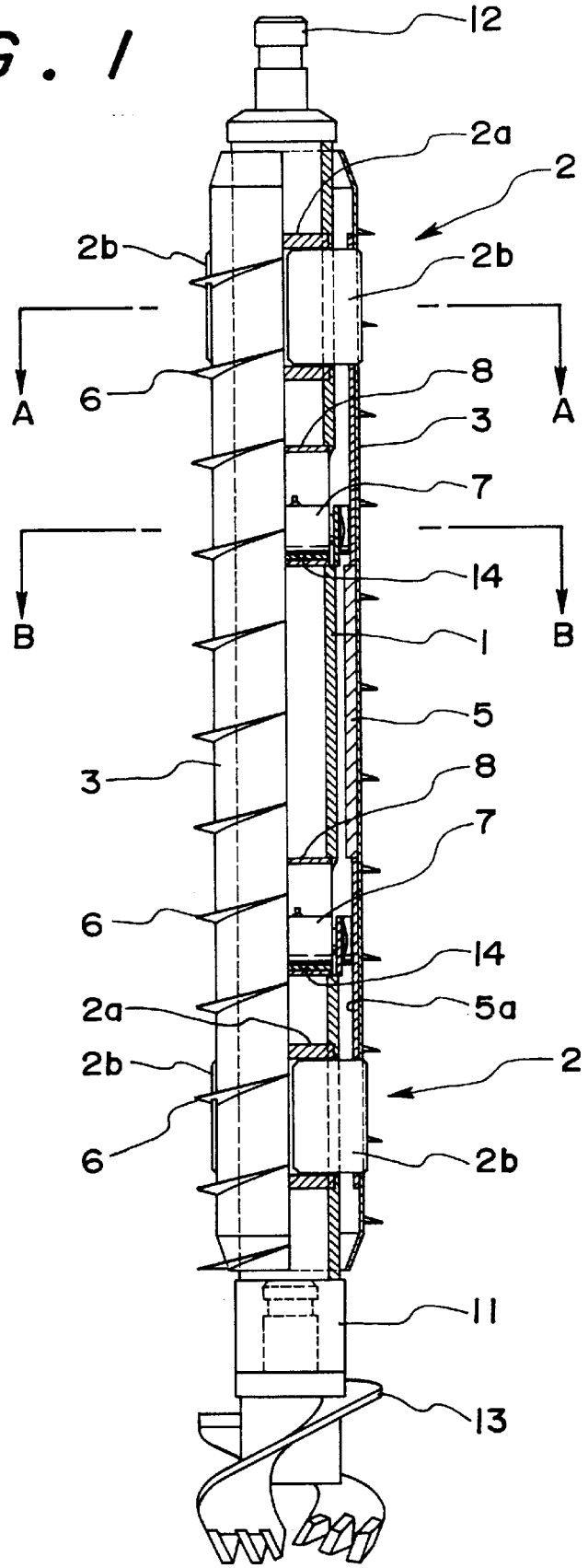
FIG. 1 is a front view partially broken away showing the mechanical ground anchor of the present invention.

As shown in FIG. 1, the mechanical ground anchor of the present invention is provided with a cylindrically shaped boring rod 1 as the core portion and a pair of anchor bodies 3,3 linked to each other and having cylindrical form divided into two parts through a slide mechanism 2 that is mounted on an outer circumferential portion of the boring rod 1. The slide mechanism 2 is mounted employing a plurality of slide mechanisms, for example two (note FIG. 1), which are spaced upwardly and downwardly along the boring rod. Each slide mechanism includes a slide piece receiving frame 2*a* and a pair of the slide pieces 2*b*,2*b* (note FIG. 2).

Figure 2:
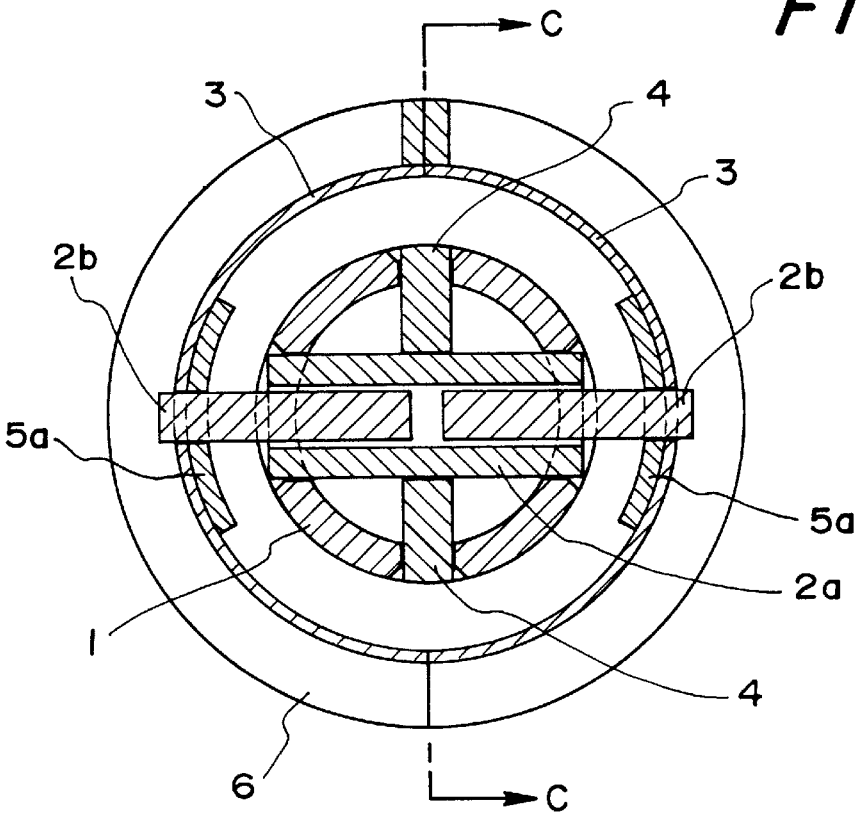
FIG. 2 shows a cross-section taken along the lines A—A of FIG. 1.
Figure 5:
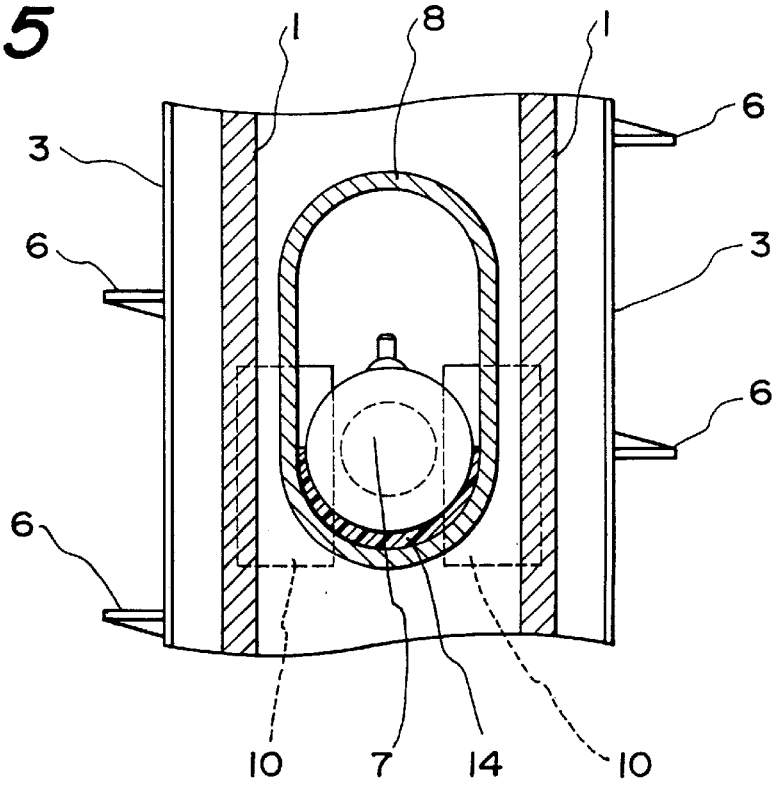
FIG. 5 shows a cross-section taken along the lines D—D of FIG. 3.

As shown in FIG. 2 and FIG. 5, each slide piece receiving frame 2*a* has a generally rectangular cross-section and is secured to the boring rod 1 crosswise to its radial direction inside the boring rod 1. To ensure securement of the slide piece receiving frame 2*a*, a reinforcing plate 4 is linked between the slide piece receiving frame 2*a* and boring rod 1.

As shown similarly in FIG. 2 and FIG. 5, the slide pieces 2*b*,2*b* are inserted into the slide piece receiving frame 2*a* so as to be movable and have a generally plate shape. Each end of these slide pieces 2*b*,2*b* extends through the anchor bodies 3, 3 and is fastened, for example by welding, with corresponding anchor bodies 3, 3.

As shown in FIG. 1 and FIG. 2, reinforcing plates 5 and 5*a* are mounted at positions corresponding to fixing positions of each slide piece 2*b* and 2*b* on the inside surface of the anchor bodies 3, 3 extending almost the entire length of the anchor bodies 3, 3. A screw 6 is mounted on the outside surface of the anchor bodies 3, 3 so as to be continuous when the ground anchor is in the closed condition.

Figure 3:
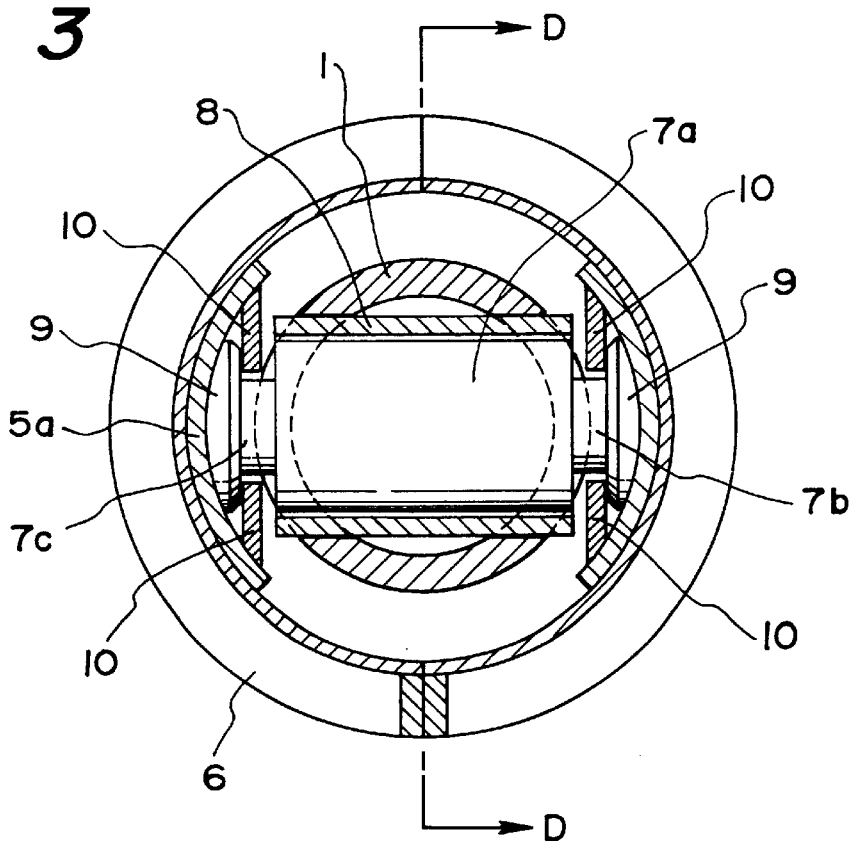
FIG. 3 shows a cross-section taken along the lines B—B of FIG. 1.
Figure 4:
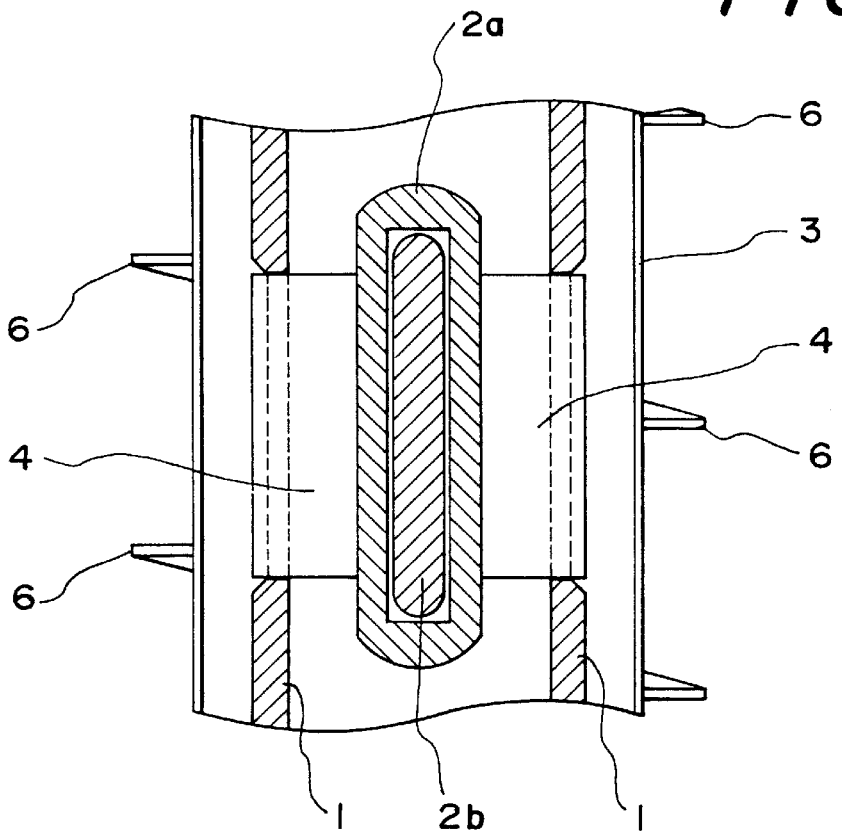
FIG. 4 shows a cross-section taken along the lines C—C of FIG. 2.

As is shown in FIG. 1, a plurality of the jacks 7, for example two, are provided in the boring rod 1 between two of the slide mechanisms 2, 2, and are spaced in the upward and downward direction. As shown in FIG. 3 and FIG. 4, each jack 7 is mounted inside of a jack frame 8 so that the jack 7 rests on a shock absorbing material 14. Each jack frame 8 has a generally elliptical form in cross-section (FIG. 5) and is fastened to the boring rod 1 crosswise to its radial direction inside the boring rod 1.

As shown in FIG. 3, a shoe 9 is mounted on an extrusion 7*c* provided on a cylinder 7*a* of the jack 7 and on the piston rod 7*b*, respectively. The extrusion 7*c* and piston rod 7*b* are linked with the anchor bodies 3,3 by hooking the shoe 9 to a pair of claws 10,10 fastened on the reinforced plate 5*a* mounted inside each anchor body. Due to such structure, no clattering occurs between the boring rod 1 and anchor bodies 3, while rotary boring is performed, and no overload is imposed on the jack 7. As shown FIG. 1, a male joint 12 is mounted on the top end of the boring rod 1 and a female joint 11 on the bottom end. The female joint 11 is combined with the boring bit 13, while the male joint 12 is combined with a cylindrical or a shaft-like boring rod which is not shown in the figure.

The following description relates to the operation of the mechanical ground anchor that is configured as explained above:

Adding other rods to the boring rod 1 successively, evacuation of soil foundation is to be performed at a selected location. Excavation is performed in the condition that the anchor bodies 3,3 remain closed, and advancing excavation is to be performed by rotating the boring rod with boring bit 13 mounted on the tip of the rod. In this case, rotational torque provided to the boring rod 1 is transmitted to the anchor 3 through the slide piece receiving frame 2*a* and slide piece 2*b*, and excavation is performed with the screw 6 mounted outside the anchor body 3 as a result. Depending on the soil foundation condition, a boring wall stabilizer such as bentonite liquid can be injected into the soil foundation from the tip of the boring rod 1.

Plate length and thickness can be designed with discretion depending on the magnitude of rotational torque and/or tensile strength imposed when boring due to the adoption of a plate as the slide piece 2*b*, and considerable section performance can be attained as a result.

Figure 6:
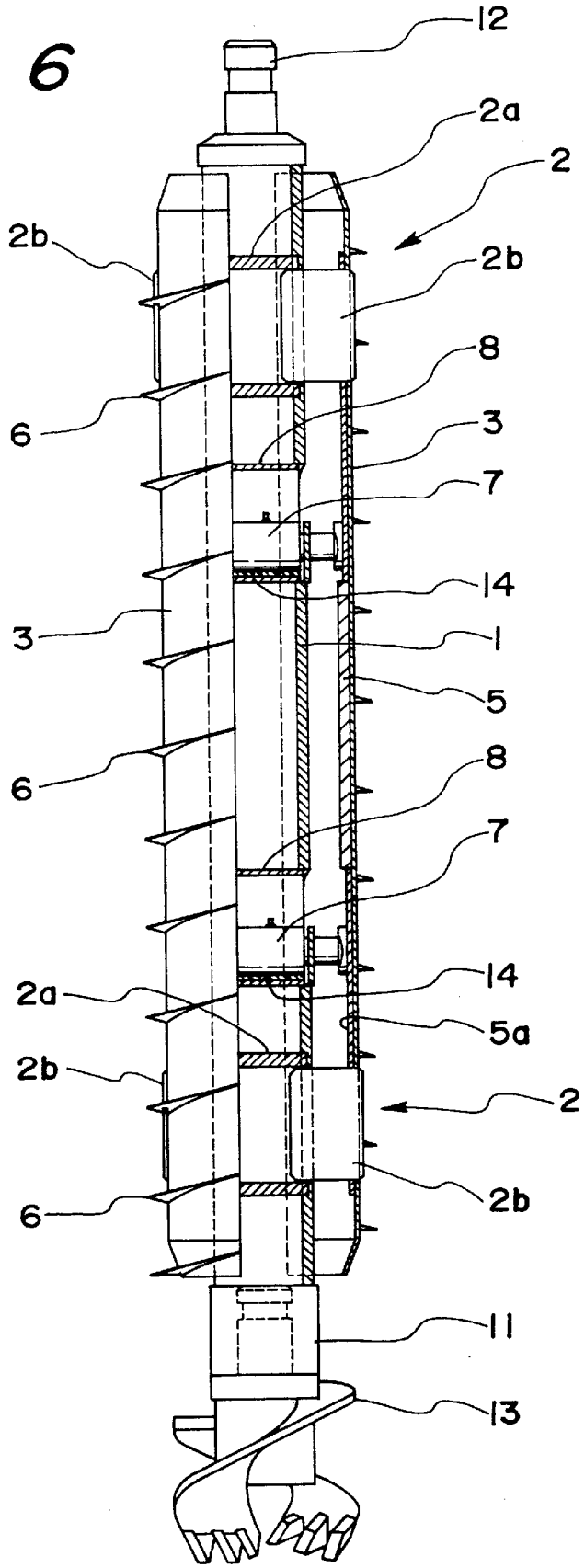
FIG. 6 is the front view showing an expanded condition of the anchor body partially broken away.

On reaching an appointed depth, excavation is suspended and, as shown in FIG. 6, the jacks 7,7 are to be activated to extend the same. This causes the slide piece 2*b* to slide inside the slide piece receiving frame 2*a* and causes the anchor bodies 3,3 to extend in parallel with each other and causes the anchor bodies to squeeze into the boring wall and stabilize it as a result. Under such condition, a perpendicular loading test of the pile can be carried out by utilizing the mechanical ground anchor as a pulling resistance body. During the test, a pulling resistance force will be transmitted between the anchor body 3 and boring rod 1 through the slide piece receiving frame 2*a* and slide piece 2*b*, which can be maximized due to the considerable section performance described above.

Once the test is completed, the jacks 7,7 are retracted. This causes the anchor bodies 3,3 to close and separate from the boring wall. Thus the mechanical ground anchor may be brought up to the ground surface to be re-used.

The foregoing embodiment is only one example of the application of the present invention, and the present invention makes it possible to make many variations for different applications. In the foregoing embodiment, for example, the slide mechanism 2 is formed of the slide piece receiving frame 2*a* mounted inside the boring rod 1 to be the core material crosswise to its radial direction and the slide pieces 2*b*,2*b* fastened on each anchor 3,3 and its end part on the opposite side of the inserted end which is inserted into the slide piece receiving frame 2*a*. However, the slide pieces 2*b*,2*b* could also be received within a penetration hole provided in the boring rod 1 instead of the slide piece receiving frame 2*a*. Further, the slide mechanism could also be formed with the slide piece 2*b* configured so that its inner end is fixed to the core material 1 to extend in a radial direction to the core material 1, an equal number of slide piece receiving frames 2*a* are fastened to the anchor body on the opposite side of the core material, and which is inserted onto the outside of the slide pieces.

In the foregoing embodiment, the composition of the cylinder divided into two parts along its axial direction is used as the anchor 3. However, a partly cylindrical form divided into three or more parts could also be used as the anchor body 3. In addition, a partly square pillar divided into plural parts along its axial direction could also be used.

Further, the slide piece 2*b* forming the slide mechanism 2 may not have only a plate shape, but may take the shape of a rod. In such a case, it becomes possible to enlarge its diameter in comparison with the existing pin joint and a considerable section performance can be attained as a result.

Further, the core material 1 is used not only in the cylindrical form but may also be formed as a shaft which is divided apart not successively in the axial direction could also be used.

As is already clear in the foregoing description, the present invention brings about the following effects:

1. For reasons that connection between the core material and anchor body, that is the section performance of the slide mechanism, can be enlarged, it becomes possible to increase rotational torque and/or tensile strength. As the result, even in case of self-boring, it becomes possible to treat such hard soil foundation as pebbly stratum and/or an extremely deep excavation.
2. Because of increasing tensile strength when using the anchor body being straddled, it becomes possible to load up to maximum pulling resistance force of the anchor body which depends on the soil foundation.
3. Not only the anchor body also the core material rotates simultaneously. Therefore, an extremely strong structure for self-boring is provided.
4. For the reason that, from the structural point of view, boring wall stabilizer such as bentonite solution is injected from the tip of the core material to soil foundation, a considerable effect could also be exhibited against collapsible soil foundation.

What is claimed is:

1. A mechanical ground anchor comprising:

an elongated core member;

an anchor body comprising a plurality of part-cylindrical members surrounding said core member and movable between a closed position close to said core member and an open position spaced radially farther from said core member than said closed position, wherein in said closed position each said part-cylindrical member abuts each adjacent said part-cylindrical member to form a closed cylindrical body, and in said open position, said part-cylindrical members are spaced apart from one another;

each said part-cylindrical member provided with at least a pair of slide mechanisms that mount said part-cylindrical members for reciprocal radial movement relative to said core member, said pair of slide mechanisms on each said part-cylindrical member being longitudinally spaced apart from one another; and at least one drive mechanism interconnecting said core member and each said part-cylindrical member to drive said part-cylindrical members between said closed position and said open position;

whereby said spaced apart slide mechanisms provide increased strength to said ground anchor during a rotary driving of said anchor into the ground.

2. The mechanical ground anchor according to claim 1, wherein each said slide mechanism comprises a slide piece fixed to one of said core member and a respective one of said part-cylindrical members, and a slide piece receiving frame connected to the other of said core member and a respective one of said part-cylindrical members, said slide piece being slidably inserted within said slide piece receiving frame to provide said reciprocal movement.

3. The mechanical ground anchor according to claim 2, wherein said slide piece is fixed to said core member and said slide piece receiving frame is fixed to a respective one of said part-cylindrical members.

4. The mechanical ground anchor according to claim 2, wherein said slide piece receiving frame is fixed to said core member and said slide piece is fixed to a respective one of said part-cylindrical members.

5. The mechanical ground anchor according to claim 1, wherein each said slide piece is generally plate-shaped, and said slide piece receiving frame has a hollow configuration with a generally rectangular inner surface sized to slidably receive said slide piece.

6. The mechanical ground anchor according to claim 1, further comprising a boring bit mounted on a lower end of said core member, whereby said ground anchor is configured for self-boring into the ground.

7. The mechanical ground anchor according to claim 1, further comprising a boring bit mounted on a lower end of said core member, and wherein each said part-cylindrical member is provided with at least one screw segment so that when said part-cylindrical members are positioned in said closed position, the screw segments on each said part-cylindrical member form a continuous screw, whereby said ground anchor is configured for self-boring into the ground.

8. The mechanical ground anchor according to claim 1, wherein each said part-cylindrical member is provided with at least one screw segment so that when said part-cylindrical members are positioned in said closed position, the screw segments on each said part-cylindrical member form a continuous screw, whereby said ground anchor is configured for self-boring into the ground.

9. A mechanical ground anchor comprising:

an elongated core member;

an anchor body comprising a plurality of body members surrounding said core member and movable between a closed position close to said core member and an open position spaced radially farther from said core member than said closed position, wherein in said closed position each said body member abuts each adjacent said body member to form a generally square closed body, and in said open position, said body members are spaced apart from one another;

each said body member is provided with at least a pair of slide mechanisms that mount said body members for reciprocal radial movement relative to said core member, said pair of slide mechanisms on each said body member being longitudinally spaced apart from one another; and at least one drive mechanism interconnecting said core member and each said body member to drive said body members between said closed position and said open position;

whereby said spaced apart slide mechanisms provide increased strength to said ground anchor during a rotary driving of said anchor into the ground.

10. The mechanical ground anchor according to claim 9, wherein each said slide mechanism comprises a slide piece fixed to one of said core member and a respective one of said body members, and a slide piece receiving frame connected to the other of said core member and a respective one of said body members, said slide piece being slidably inserted within said slide piece receiving frame to provide said reciprocal movement.

11. The mechanical ground anchor according to claim 10, wherein said slide piece is fixed to said core member and said slide piece receiving frame is fixed to a respective one of said body members.

12. The mechanical ground anchor according to claim 10, wherein said slide piece receiving frame is fixed to said core member and said slide piece is fixed to a respective one of said body members.

13. The mechanical ground anchor according to claim 9, wherein each said slide piece is generally plate-shaped, and said slide piece receiving frame has a hollow configuration with a generally rectangular inner surface sized to slidably receive said slide piece.

14. The mechanical ground anchor according to claim 9, further comprising a boring bit mounted on a lower end of said core member, whereby said ground anchor is configured for self-boring into the ground.

15. The mechanical ground anchor according to claim p, further comprising a boring bit mounted on a lower end of said core member, and wherein each said part-cylindrical member is provided with at least one screw segment so that when said part-cylindrical members are positioned in said closed position, the screw segments on each said part-cylindrical member form a continuous screw, whereby said ground anchor is configured for self-boring into the ground.

16. The mechanical ground anchor according to claim 9, wherein each said part-cylindrical member is provided with at least one screw segment so that when said part-cylindrical members are positioned in said closed position, the screw segments on each said part-cylindrical member form a continuous screw, whereby said ground anchor is configured for self-boring into the ground.

* * * * *

UNITED STATES PATENT AND TRADEMARK OFFICE

CERTIFICATE OF CORRECTION

PATENT NO. : 6,210,077 B1
DATED : April 3, 2001
INVENTOR(S) : S. Kondo

It is certified that error appears in the above-identified patent and that said Letters Patent is hereby corrected as shown below:

Column 6,
Line 46, "p" should be -- 9 --.

Signed and Sealed this

Twenty-sixth Day of March, 2002

*Attest:*

*Attesting Officer*

JAMES E. ROGAN
*Director of the United States Patent and Trademark Office*